United States Patent [19]

Coppens et al.

[11] Patent Number: 4,533,332

[45] Date of Patent: Aug. 6, 1985

[54] MOORING SYSTEM

[75] Inventors: Anton Coppens; Leendert Poldervaart, both of La Turbie, France

[73] Assignee: Single Buoy Moorings, Inc., Fribourg, Switzerland

[21] Appl. No.: 463,053

[22] Filed: Feb. 1, 1983

[30] Foreign Application Priority Data

Feb. 1, 1982 [NL] Netherlands ..... 8200358

[51] Int. Cl.[3] ..... B63B 21/52

[52] U.S. Cl. ..... 441/3; 114/230

[58] Field of Search ..... 441/3, 4, 5; 114/230, 114/266

[56] References Cited

U.S. PATENT DOCUMENTS

| | | | |
|---|---|---|---|
| 2,650,558 | 9/1953 | Nizery | 114/266 |
| 3,155,069 | 11/1964 | Ross et al. | 114/230 |
| 3,366,088 | 1/1968 | Gibson | 441/5 |
| 3,519,036 | 7/1970 | Manning | 441/5 |
| 3,535,883 | 10/1970 | Manning | 441/4 |
| 3,550,549 | 12/1970 | Horton | 114/230 |
| 3,786,525 | 1/1974 | Christians . | |
| 4,010,500 | 3/1977 | Reid | 441/5 |
| 4,106,146 | 8/1978 | Maari | 114/230 |
| 4,148,107 | 4/1979 | Karl et al. | 441/3 |
| 4,176,615 | 12/1979 | Reid et al. | 441/5 |
| 4,286,898 | 9/1981 | Stafford . | |

FOREIGN PATENT DOCUMENTS

| | | | |
|---|---|---|---|
| 2386758 | 3/1978 | France . | |
| 1384983 | 2/1975 | United Kingdom | 44/5 |
| 2043008 | 1/1980 | United Kingdom . | |

*Primary Examiner*—Trygve M. Blix
*Assistant Examiner*—Thomas J. Brahan
*Attorney, Agent, or Firm*—Young & Thompson

[57] ABSTRACT

A mooring system comprising a buoy, which is anchored by anchor chains. The buoy has a horizontal pivot shaft for connection with the device to be moored and this shaft is positioned at a part of the buoy, which is rotatable about a vertical shaft relative to the part to which the chains are secured. The buoy comprises at least two spaced buoyant members which are interconnected by a bridge member in which a turntable is journalled. The bridge member furthermore comprises the horizontal pivot shaft.

2 Claims, 4 Drawing Figures

MOORING SYSTEM

The invention relates to a mooring system comprising a buoy, which is anchored by means of anchor chains, said buoy has a horizontal shaft of rotation for connecting to the device to be moored, which shaft is positioned at a part of said buoy, which is rotatable about a vertical shaft relative to the part to which the anchor chains are secured.

Such a mooring system is for instance known from U.S. Pat. No. 2,882,536, disclosing a permanent connection between a buoy and a mooring device secured thereto by a rigid arm, and for instance known from Dutch Pat. No. 110,056 disclosing a buoy to which a tanker vessel can be secured by means of a mooring rope.

In both cases the buoy supports a turntable which is rotatable about a vertical shaft, to which turntable connection members are secured connecting the device to be moored to the buoy, which connection members thus can comprise a pivotably secured rigid arm or a mooring rope. Furthermore from the British Patent Application No. 204,308 a system is known comprising a stiff arm connection between the tanker vessel and the buoy, to secure the anchor chains to a body which is rotatable relative to the buoy about a vertical shaft, which means said buoy is rotating.

In many known mooring systems there is a large distance in vertical direction between the point where the anchor chains engage and the point where the connection with the device to be moored or the moored device takes place and said distance results in large loads in the bearings because of the large bearing moment caused by the movements of the buoy and the moored device.

In said mooring systems in which the anchor chains are directly connected to the buoy body, connection members shaped like mooring ropes or arms, engage a turntable between the moored device and the buoy at the location of the buoy, the bearing of which turntable has a large diameter to take up large moments in said bearing. The known buoy bodies mostly are cylindrical and conduits subjected through said body embodied as hoses underneath the buoy, while at the top of the buoy a rotatable connection is provided from which the connection hoses extend to the moored device. If the buoy is subjected to considerable movements the hoses also move and this is disadvantageous for the life time of the hoses. Thus the buoy should have some stability of its own which results in comparatively large dimensions unless in case of a connection by a rigid arm one eliminates the horizontal pivot shaft between the rigid arm and the buoy body at the location of the buoy body, as is known per se from the British Patent Specification No. 1,934,505. In the last mentioned case the buoy body can have small dimensions but in the arm still comparatively large forces appear.

It is the object of the invention to provide a mooring device with a buoy having a simple structure, permitting an appropriate bearing construction, i.e. a construction not being too large or too small, having a good stability of its own, permitting the pivot joint to be positioned near the engaging points of the anchor chains and providing also a good accessibility to the securing points of the anchor chains.

According to the invention this is realized by a buoy comprising at least two spaced buoyant members, which buoyant members are interconnected by a bridge member in which the turntable is journalled and which bridge member comprises the horizontal pivot shaft. Said spaced buoyant members are embodied as cylindrical buoyant members which are cylindrical about a horizontal axis or embodied as buoyant members of which the buoyancy increases progressively less as the body is progressively submerged. This will appear for instance with a cylindrical buoyant member which is normally submerged to or somewhat beyond its horizontal central intersecting plane.

Preferably one also will use only two parallel buoyant members, although it is conceivable to use four buoyant members arranged in two series of two.

The spaced buoyant members form a simple structure for a buoy of sufficient dimensions to provide its own stability, whereby the decreasing increase of the buoyancy at deeper immersion decreases the influence of the wave movements. In other words the buoyant members comprise the horizontal hinge for connecting the mooring means. The anchor chains are secured to a turntable, which is supported in the bridge member by means of roller bearings. The diameter of this roller bearing is sufficient to accommodate the downwardly extending conduits but smaller than the distance between the buoyant members. The anchor chains are easily accessible from the bridge member which is of importance for the attachment, for checking and eventually for tensioning.

The buoyant members extend preferably with their horizontal axis in the direction in which forces are exerted by the moored device. A mooring device according to the invention for instance comprising cylindrical buoyant members can be suitable for temporarily securing a tanker vessel as well as for the more permanent securing of a tanker vessel by means of a rigid arm. In the last case it is desirable that the end of the arm facing away from the moored device have a pivot shaft near the attachment of the horizontal shaft on the bridge member extending in the plane through both horizontal pivot shafts of the arm and being perpendicular to those shafts. Rolling movements of the moored device around the longitudinal axis are in this case not transmitted to the buoy. A mooring system with a similar longitudinal axis is known from U.S. Pat. No. 2,882,536, but here the longitudinal shaft is mounted on the moored device and not on the buoy. As a result of the rotating and shearing movement of the moored device the longitudinal shaft mounted thereon does not remain in the plane of the arm so that the movements around the longitudinal shaft of the moored device are still partly transmitted to the buoy.

It is noted that from the published Dutch Patent Application No. 6,913,371 a mooring buoy comprising two cylindrical buoyant members is known, which are connected at the front side and at the rear side by bridge members. In this case however there is a buoy with a single anchor line between ship and bottom anchor, while means permitting rotation about a vertical axis of the buoy and the moored device relative to each other or relative to the anchor chains and transshipment means are lacking.

The invention will now be described by way of example with reference to the accompanying drawings, in which.

Figure 1:
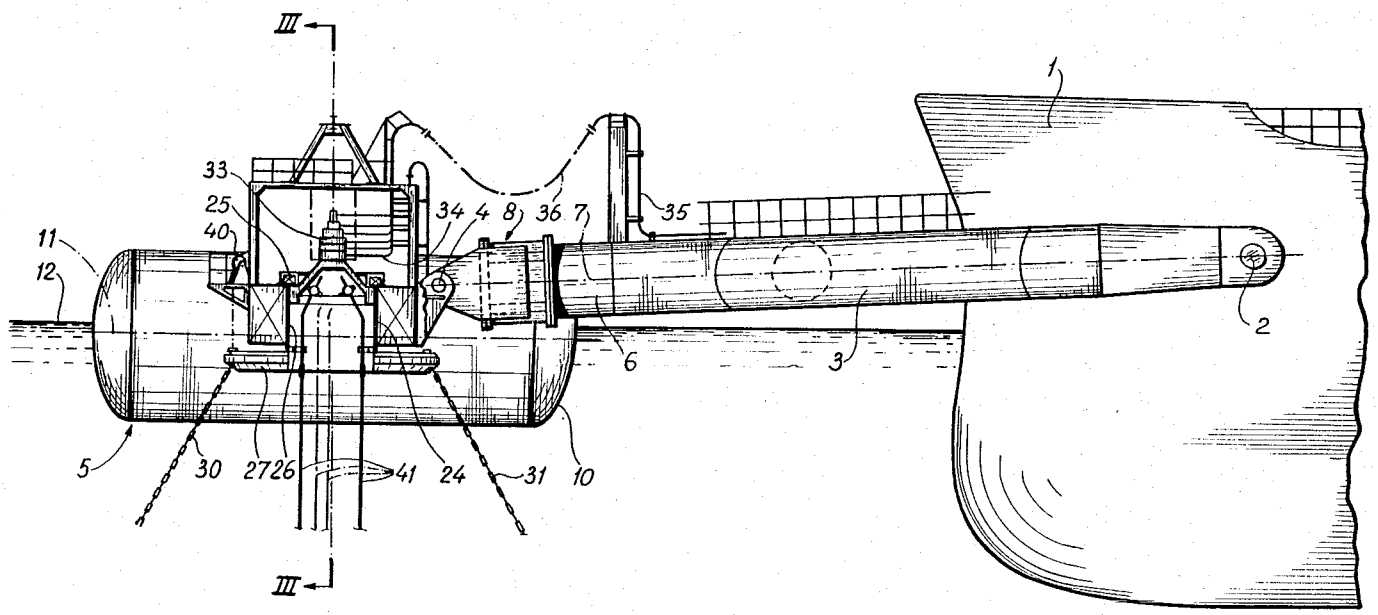
FIG. 1 shows the device according to the invention in side elevation and partially in section.
Figure 2:
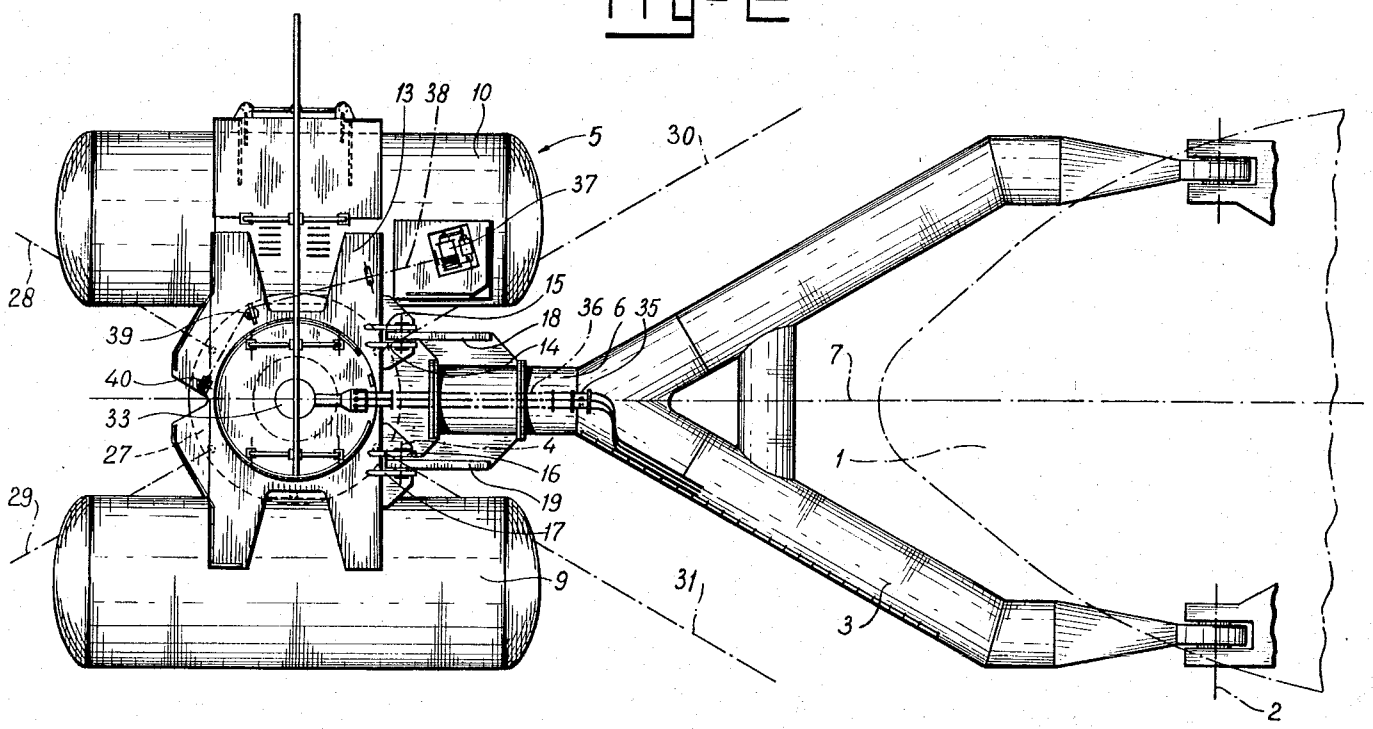
FIG. 2 is a top view of the device of FIG. 1.

FIGS. 1 and 2 show a tanker 1 to which a rigid arm 3 is connected by a horizontal pivot shaft 2, said rigid arm having an A-shaped frame, as shown in FIG. 2. This arm 3 pivoted at 4 by means of a horizontal pivot shaft, which is placed in the buoy generally indicated by 5.

The extremity 6 of frame 3 adjacent pivot shaft 4 is embodied such that pivoting is possible around axis 7, which is disposed in the plane through the horizontal pivot shafts 2 and 4. The pivot sleeve structure provided for this purpose is generally indicated by 8.

Figure 3:
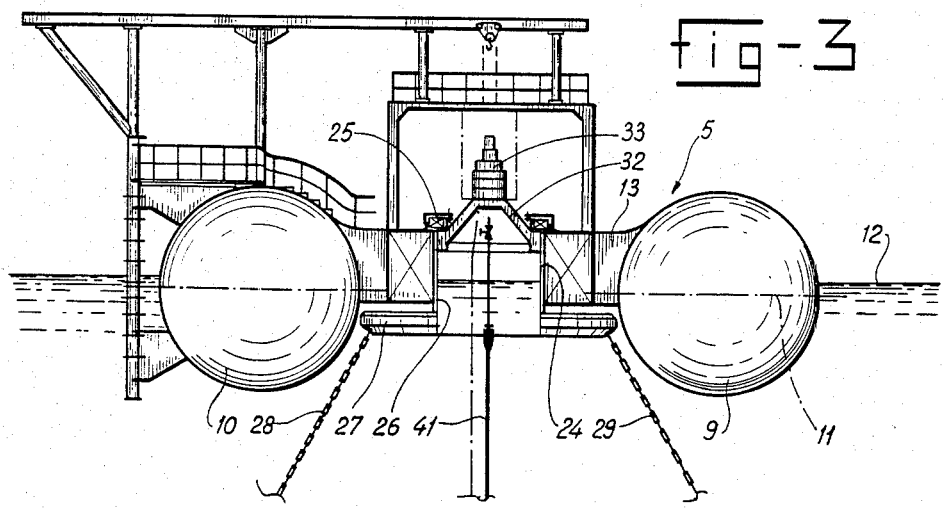
FIG. 3 is a cross sectional view on the line III—III of FIG. 1.

The buoy comprises two cylindrical buoyant members 9 and 10. These are normally submerged beyond their largest diameter, as is shown in FIGS. 1 and 3. These Figs. show the horizontal central intersecting plane 11 being below water surface 12. The buoyancy needed to support the anchor chains is available in the buoyant members 9 and 10. Because these buoyant members are relatively long and have a good mutual distance a large stability is obtained against rolling and pitching. This means that a buoy with such buoyant members remains relatively calm in turbulent water. A normal buoy of the cylindrical type has a diameter of for instance 14 meters. The buoyant members of the buoy according to the invention can have an increased length, for instance 24 meters and the width of the buoy can be the same and so can be adapted to the wave pattern without requiring such material or impairing the wave resistance.

Both buoyant members 9 and 10 are interconnected by a bridge member 13 which is placed therebetween. To this bridge member 13 strips or brackets 14, 15, 16 and 17 are secured cooperating with fork legs 18 and 19 of the arm 3 to form the horizontal hinge 4.

Figure 4:
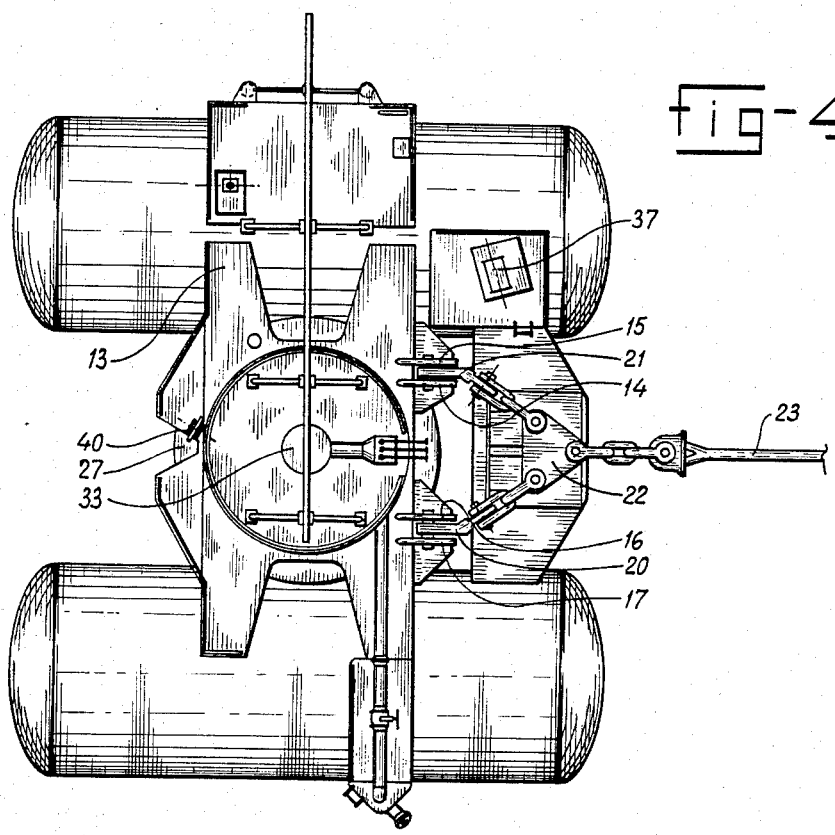
FIG. 4 shows the device shown in FIG. 2 with another embodiment of the mooring means.

As is shown in FIG. 4 also the extremities 20 and 21 of a chain yoke 22 attached to a mooring rope 23 can be connected to these securing strips 14 to 17.

As is most clearly shown in FIGS. 1 and 3 the bridge member has a central opening 24 in which a cylindrical element 26 is journalled by means of roller bearing 25, said cylindrical element supporting a ring 27 to which anchor chains 28, 29, 31 are secured.

Because of the relatively small vertical distance between the bearing 25 and ring 27, upon large horizontal displacement of the moored tanker caused by waves, wind and stream forces, only a relatively small moment acts in the vulnerable bearing 25.

Said cylindrical element 26 supports a bracket 32 on which the rotatable conduit connection 33 is mounted from which conduits 34 can extend (see FIG. 2) to tanker 1 through rigid arm 3, said conduits 34 and 35 being interconnected by hoses 36 bridging the pivot structure 4 and 8.

The ring to which the anchor chains are connected, can rotate within the range defined by buoyant members 9 and 10 which means that the buoyant members 9 and 10 can move about the anchor attachment. Tensioning of the anchor chains is however possible by means of a winch 37 and a tensioning cable 38, which extends over guides 39 and 40.

In many known mooring devices chain stoppers for the anchor chains are installed at a difficult accessible place and the tensioning of the chains is complicated.

Downwardly extending conduits 41 pass from connection 33 through the central cylindrical element 26.

We claim:

1. In a mooring system comprising a buoy of the type floating at the water surface, which buoy is anchored by means of anchor chains, a floating vessel, a rigid arm interconnecting the vessel and buoy, said arm being connected with the vessel pivotably only about a horizontal axis extending transversely to the length of the arm and of the vessel; the improvement in which the buoy comprises at least two spaced-apart parallel elongated floats which are interconnected by a bridge member and which extend parallel to the length of the rigid arm and vessel, said bridge member having a turntable journalled thereon for rotation about a vertical axis, means connecting said anchor chains to said turntable, said arm being connected pivotably with the bridge member about a second horizontal axis parallel to the first mentioned horizontal axis, and means pivotably interconnecting said bridge member and said rigid arm for rotation relative to each other about an axis perpendicular to and passing through said second horizontal axis and extending lengthwise of said rigid arm.

2. Mooring system as claimed in claim 1, said rigid arm lying in the plane defined by said first mentioned axis and said second horizontal axis.

* * * * *